US008114232B2

(12) United States Patent
Lisec

(10) Patent No.: US 8,114,232 B2
(45) Date of Patent: Feb. 14, 2012

(54) METHOD AND AN APPARATUS FOR PRODUCING AN INSULATING GLASS PANE

(76) Inventor: Peter Lisec, Hausmening-Amstetten (AT)

( * ) Notice: Subject to any disclaimer, the term of this patent is extended or adjusted under 35 U.S.C. 154(b) by 1106 days.

(21) Appl. No.: 11/364,545

(22) Filed: Mar. 1, 2006

(65) Prior Publication Data

US 2006/0201606 A1 Sep. 14, 2006

Related U.S. Application Data

(63) Continuation of application No. PCT/IB2005/002050, filed on Jun. 13, 2005.

(30) Foreign Application Priority Data

Jul. 1, 2004 (DE) ..... 10 2004 032 023

(51) Int. Cl.
*B32B 37/12* (2006.01)
*B32B 41/00* (2006.01)

(52) U.S. Cl. ..... 156/64; 156/99; 156/104; 156/107; 156/109; 156/361

(58) Field of Classification Search ..... 156/99, 156/104, 106, 107, 109, 64, 360, 361, 356; 427/8–10
See application file for complete search history.

(56) References Cited

U.S. PATENT DOCUMENTS 3,399,294 A 8/1968 Thieben
3,536,551 A * 10/1970 Simon ..... 156/64
4,431,691 A 2/1984 Greenlee
6,148,890 A 11/2000 Lafond et al.
7,347,909 B2 3/2008 Reichert
2002/0069823 A1 * 6/2002 Briese et al. ..... 118/692
2003/0029134 A1 2/2003 Deane
2003/0178127 A1 9/2003 Lisec
2004/0000367 A1 * 1/2004 McGlinchy ..... 156/64
2005/0167028 A1 8/2005 Reichert
2005/0247392 A1 11/2005 Lisec
2006/0037262 A1 2/2006 Siebert et al.

FOREIGN PATENT DOCUMENTS

EP 0 709 539 A1 5/1996

OTHER PUBLICATIONS

Edgetech online reference. Mar. 26, 2003. URL: http://web.archive.org/web/20030326185420/http://edgetechig.com/.*
Warm Edge Digest, Edgetech, North American Edition, vol. 3, No. 1, Winter 2000.

* cited by examiner

*Primary Examiner* — Christopher Schatz
(74) *Attorney, Agent, or Firm* — Edell, Shapiro & Finnan, LLC

(57) ABSTRACT

An insulating glass pane structure including two glass panes is formed by providing an elastoplastic strip from a delivery reel, where the elastoplastic strip has a varying dimension along its width including a first, nominal width section and a second, reduced width section that is smaller in width than the nominal width section. Side surface area portions of the nominal width section of the strip are coated with a first adhesive glue, and side surface area portions of the reduced width section of the strip are coated with a second adhesive glue that is diffusion-proof against water vapor. One side surface of the strip is pressed against a first glass pane to form a spacer, the strip being pressed close to an edge of the first glass pane, and the second glass pane is applied and pressed to form the glass pane structure.

4 Claims, 3 Drawing Sheets

METHOD AND AN APPARATUS FOR PRODUCING AN INSULATING GLASS PANE

CROSS REFERENCE TO RELATED APPLICATIONS

This application is a continuation of International Application No. PCT/IB2005/002050, filed on Jun. 13, 2005, and titled "Method and an Apparatus for Producing an Insulating Glass Pane," and further claims priority under 35 USC §119 to German Application No. DE 10 2004 032 023.3, filed on Jul. 1, 2004, and titled "Method and an Apparatus for Producing an Insulating Glass Pane," the entire contents of which are hereby incorporated by reference.

FIELD OF THE INVENTION

Then present invention relates to a method and an apparatus for producing insulating glass panes from at least two glass panes between which an elastoplastic strip is arranged as a spacer.

BACKGROUND

The spacers between an insulating glass unit including two or more glass panes are typically constructed of aluminum or hollow steel.

A spacer in the form of a strip with a rectangular cross section which is frequently designated as a "swiggle strip" is described in German Patent Document No. DE 30 02 904 A. The strip is provided with protective films, comes from a delivery drum or reel and is applied to the glass pane by means of an apparatus provided with a turnable head. The strip-like spacer is viscoplastic, strongly adhesive (which is desirable for achieving a gas-tight connection at first with the first glass pane and later with the second glass pane of the insulating glass unit), but has a viscosity which is strongly temperature-dependent.

Recently, substantially less temperature-sensitive elastoplastic spacer strips have been developed on the basis of polyurethane or the like. The strips also have a rectangular cross section, are more stable with respect to dimensions and shape than the so-called "swiggle strip," include a lamination made of aluminum foil on the outside and are provided on the two narrow sides, designated for gluing with the glass panes, with a factory-made thin coating being made of a strongly adhesive glue. The coating is covered with protective foils until the application is made. A method and an apparatus for applying such a strip onto at least the first glass pane of an insulating glass unit consisting of at least two such glass panes is described in German Patent Document No. DE 102 12 359 A.

A noticeable problem with such a strip is that the adhesive applied to the two narrow sides of the strip is not diffusion-proof to water vapor. The adhesive presumably includes a rapidly polymerizing adhesive lacquer composed of methacrylates. That is why, in current methods, the remaining boundary gap is filled with a sealing mass after the assembly of the insulating glass pane, which mass ensures the mandatory tightness against the diffusion of water vapor, because otherwise water vapor would penetrate the enclosed inner space of the insulating glass pane and would unavoidably lead to the formation of condensate and the uselessness of the pane. Suitable filling masses for the boundary gaps are expensive and are required in large quantities due to the considerable cross section.

In German Patent Application No. 103 50 312.9, a more advantageous method is described which works with the same elastoplastic strip but which is not coated with the adhesive on the two narrow sides. A water-vapor diffusion-proof adhesive, preferably a butyl adhesive, is applied onto the narrow sides of the strip only shortly before its application onto the glass panel. It has been noticed, however, that in contrast to the long known and generally common rigid spacer frames with butyl-coated side surfaces, there may occur, as a result of the limited adhesion forces of the butyl adhesive (especially in the case of strips which are wide in proportion to their thickness or in the case of large pane formats and respective long strips) that the strip applied to the first glass pane will travel at certain locations even prior to the application of the second glass pane and/or during the pressing of the two glass panes into the insulating glass unit. In other words, the strip moves slightly from the defined position. This can lead to visual impairments of the finished insulating glass unit by a "wavy" appearance of the spacer and/or the imprecise rectangular configurations of the corners of the spacer.

There is a desire to use suitable plastic strips instead of metallic spacers for reasons of better heat insulation.

SUMMARY OF THE INVENTION

The invention provides an improvement to the method described above of using an elastoplastic strip and also an apparatus which is especially suitable for performing the improved method.

In accordance with the present invention, a

The above and still further features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION

Figure 1:
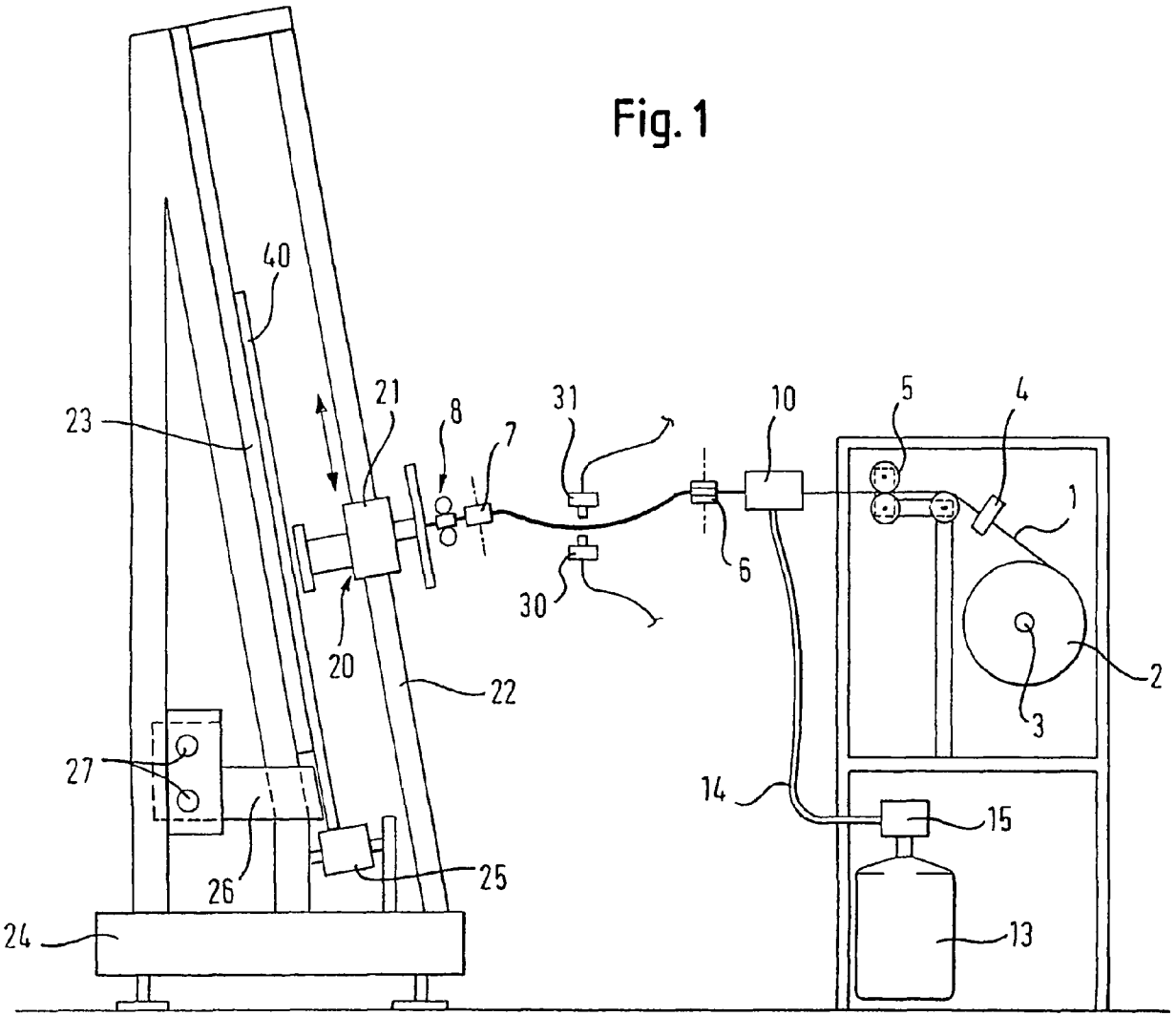
FIG. 1 depicts a simplified side view of an apparatus for applying a spacer in accordance with the present invention.

In accordance with the present invention, an elastoplastic band is used which is not provided with a regular rectangular cross section but rather with a slightly stepped rectangular cross section or, alternatively, a trapezoid cross section. Each of the two side surfaces of the band includes a strip-like partial surface area, where the partial surface area corresponding to the larger width is coated preferably already by the vendor with the strongly adhesive glue with a layer thickness of usually considerably less than $1/10^{th}$ mm, whereas the other strip-like partial surface area which is set back or is situated deeper than the other surface is then free of adhesive in the delivery state of the strip. Shortly before the application of the strip, a second adhesive is applied to the lower-lying strip-like partial surface areas of the side surfaces on both sides, which second adhesive ensures the necessary tightness against the diffusion of water vapor. The layer thickness of this adhesive usually lies in the region of a few tenths of a millimeter. The strip is narrower by this layer thickness in the region of the partial surface areas on both sides, so that the application of the second adhesive at least approximately compensates the step between the two partial surface areas.

During the application of the strip onto the glass pane, the film-like strong adhesive ensures that the strip will adhere in a precise and unmovable manner in its predetermined position on the first glass pane and the second adhesive ensures the diffusion-proofjoint of the strip or spacer with the glass pane. The same applies to the application of the second glass pane and the pressing of the unit. The remaining boundary gap is filled as known with a sealing mass which does not have to be diffusion-proof to water vapor and can therefore be less expensive than the previously required sealing masses.

A butyl adhesive is preferably used as an adhesive, and is very useful in the coating of the side surfaces of the said spacer frames made of hollow metal profiles.

In the method according to the invention, the strip is preferably placed by an automatically working application station on the first glass pane and pressed against the same.

The quantity of adhesive applied to the strip is appropriately regulated depending on the strip conveying speed, which occurs in such a way that the most constant thickness of adhesive layer is obtained. This can be achieved in such a way that the quantity of adhesive which is consumed per unit of time for the application is kept proportional to the strip conveying speed, which means that it drops to zero in the case of a standstill of the strip.

The thickness of the adhesive coating is preferably kept approximately constant irrespective of the conveying speed. This can be achieved especially in such a way that the actual value of the thickness of the coating is measured and the deviation from a predetermined setpoint value is used as an error signal for keeping constant the thickness of the coating. Suitable layer thickness measuring methods are generally known.

In addition, an apparatus is provided in accordance with the invention that includes a delivery reel for the strip, several driven strip guide rollers and a pressing head for the strip which is movable relative to a first glass pane. Mutually opposite nozzles for coating the lower lying strip-like partial surface areas of the side surfaces of the strip with an adhesive which is diffusion-proof to water vapor are arranged between the delivery reel and the pressing head. The coating nozzles can be associated with a mechanism for controlling the adhesive throughput depending on the strip conveying speed.

At least one pair of rollers for the lateral guidance of the strip can be arranged in front of the coating nozzles relating to the strip conveying direction.

A height guidance for the strip can be arranged in addition before the coating nozzles relating to the strip conveying direction, where the height guidance can optionally consist only of a simple horizontal supporting bridge, a supporting roller on which the strip rests or of a pair of rollers between which the strip passes.

When the coating station is not integrated in the pressing head, pairs of rollers can be arranged even after the coating nozzles relating to the strip conveying direction for the lateral guidance of the strip whose rollers will appropriately only touch the strip only on the edges of the lateral surfaces of the strip in order to avoid any contamination of the rollers by the freshly applied adhesive layer and conversely by avoiding any damage to the latter.

In the case of precise dosing, a strand of adhesive can be applied centrally onto each of the partial surface areas of the side surfaces, with the cross section of the strand being dimensioned in such a way that an even adhesive layer is obtained when pressing the strip against the first glass pane or when pressing the second glass pane to the other side surface of the strip without adhesive pouring over the edges of the side surfaces of the strip. It is usually simpler, however, to configure the coating nozzles as slotted nozzles.

The width of the slots of the coating nozzles can be smaller than the width of the respective partial surface areas of the side surfaces of the strip, so that, under the precondition of an application of adhesive which does not occur too generously, the respective coating reaches not quite up to the edges of the side surfaces of the strip. This ensures that further lateral guide means such as the aforementioned pairs of rollers will not come into contact with the adhesive coating in the case of a V-shaped profiling for example and will therefore not contaminate the same.

In addition, a device for measuring the thickness of the coating can be arranged after the coating nozzles relating to the strip conveying direction in accordance with the invention, where the device regulates the throughput of adhesive through the coating nozzles.

The method and apparatus in accordance with the invention is described in further detail below with respect to the exemplary embodiments of FIGS. 1-4.

Figure 2:
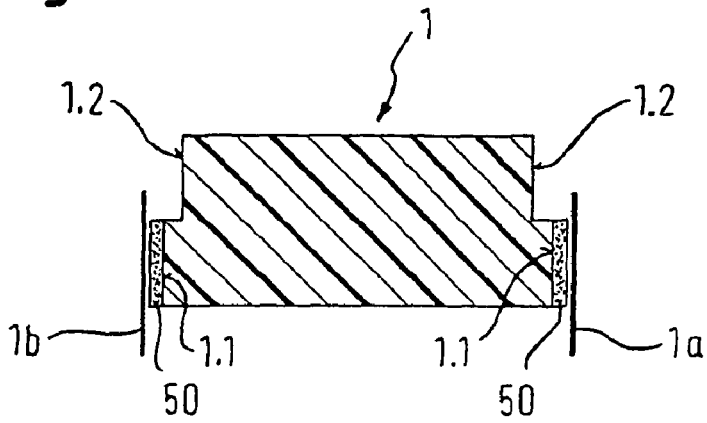
FIG. 2 depicts a cross-sectional view of a spacer strip with protective foils in accordance with the present invention.
Figure 3:
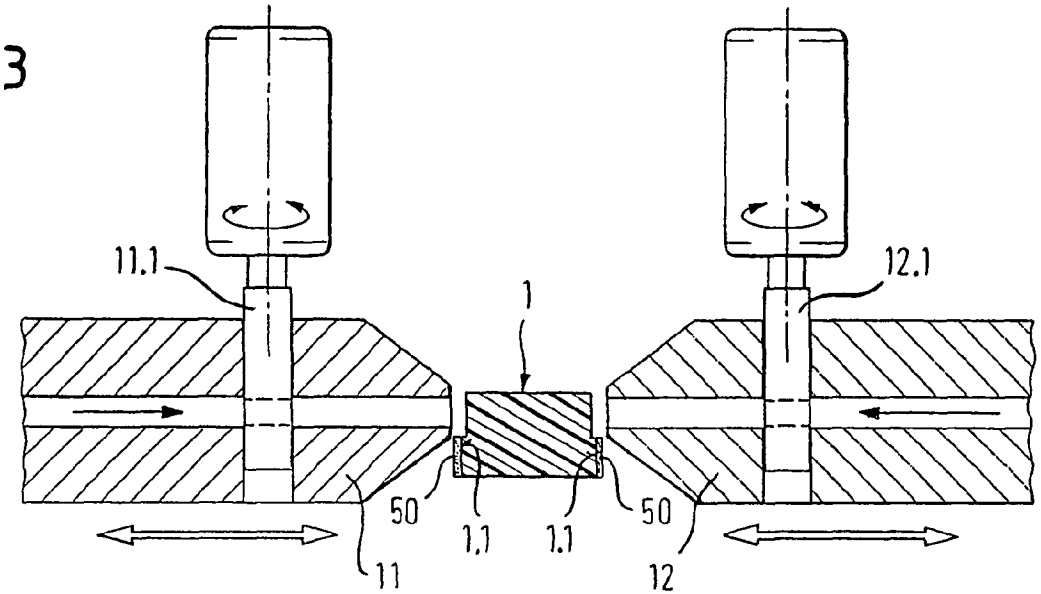
FIG. 3 depicts an enlarged cross-sectional view of the spacer strip of FIG. 2 between coating nozzles in accordance with the present invention.
Figure 4:
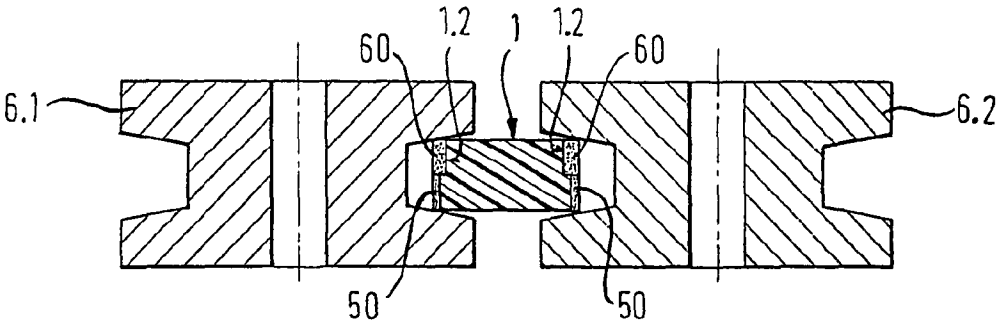
FIG. 4 depicts an enlarged cross-sectional view of a downstream pair of rollers for lateral guidance of the strip in accordance with the present invention.

Referring to FIGS. 1 and 2, an elastoplastic strip 1 with the stepped rectangular cross section (as shown in FIG. 2) is drawn off from a delivery reel 2 which is situated on a driven shaft 3, via a height or path-measuring device 4 and indicated guide rollers 5. The two side surfaces of the strip 1, which are described below in closer detail by reference to FIGS. 2 to 4, are each covered with a protective foil 1*a*, 1*b* (see FIG. 2) that is removed before or after the path-measuring device 4 and are wound up for disposal. This is known and therefore not shown. The strip 1 runs into a coating station 10 which is connected via a line 14 with a pump 15 on a container 13 containing a butyl adhesive. The coating station 10, in which a narrow strip of a butyl adhesive layer is applied to each of the two side surfaces of the strip, is followed by a pair of rollers 6 for lateral guidance of the coated strip. This is followed by a section in which the strip 1 sags freely. The sagging is held between an (upper) minimum value and a (bottom) maximum value by a bottom sensor 30 and an upper sensor 31 which are connected by way of the indicated signal cables with the machine control unit (not shown); this occurs in a manner that the machine control unit acts upon the respective reel and roller drives depending on the signals of the sensors 30 and 31. This ensures that the strip then travels into an indicated application or pressing head 20 neither compressed nor extended by way of further pairs of rollers 7 and 8, which head is movable by way of a carriage 21 in the direction of the double arrow on a column 22. The column 22 is slightly inclined against the plumb line and parallel to a conventional supporting wall 23, e.g. air cushion supporting wall which rests on the machine frame 24. A glass pane 40 leans against the supporting wall 23 whose bottom edge stands on the indicated roller conveyor 25. The glass pane 40 can be conveyed in a reversible manner by the roller conveyor or by a vacuum conveyor 26 of known configuration. The pressing head 20 can be turned on its part about an axis rectangular relative to the column 22. As a result of a respectively controlled relative displacement of the pressing head 20 relative to the glass pane 40, the strip 1 is pressed circumferentially close to the edge against the glass pane 40, as is generally known.

In another embodiment which is not shown, the apparatus also includes a station that applies the strongly adhesive film-like adhesive 50 in FIG. 2, etc. The strip is then supplied free from any adhesive and without a protective foil. Apart from this, the coating station 10 can also be integrated in the pressing head 20, so that the coating with the butyl adhesive occurs only directly before the pressing of the strip onto the glass pane 40.

Figure 2A:
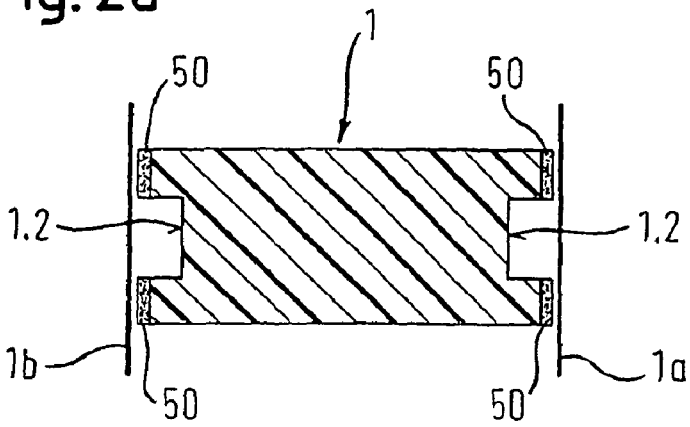
FIGS. 2*a* and 2*b* depict cross-sectional views of further embodiments of a spacer strip in accordance with the present invention.
Figure 2B:
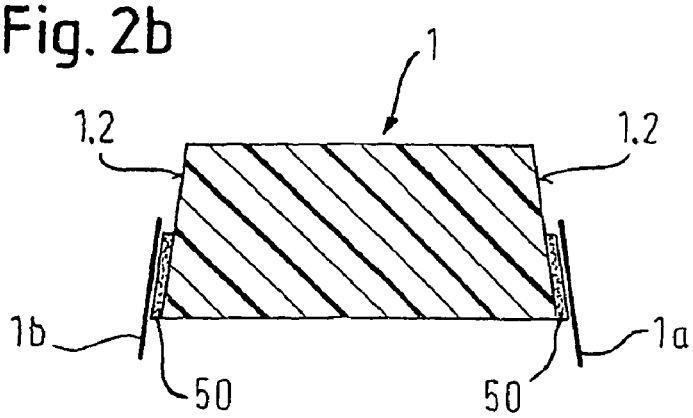

FIG. 2 shows a cross-sectional view through the strip 1 in the delivered state, i.e. usually wound up on the reel 2 in FIG. 1. The strip includes a slightly stepped rectangular cross section. The illustration is not according to scale. Each of the two side surfaces is divided into a strip-like partial surface area 1.1 and an adjacent partial surface area 1.2 which is set back or lies deeper by a few tenths of a millimeter. A very thick layer of an adhesive 50 is situated on each of the partial surface areas 1.1, which adhesive has a very high adhesive power and is strongly adhesive on glass after the withdrawal of the aforementioned protective foils 1*a*, 1*b*. As already shown, the partial surface areas 1.1 and 1.2 can have approximately the same width. In the case of a sufficiently high adhesive power of the adhesive 50, the strip 1.1 can be narrower for the benefit of a larger width of strip 1.2. The illustrated stepped rectangular cross section is exemplary. The strip can also have the double stepped or grooved cross section as shown in FIG. 2*a*, with the groove being configured as a concave channel instead of the illustrated rectangular cross section. The slightly trapezoid cross section as shown in FIG. 2*b* is another possible embodiment.

FIG. 3 schematically shows the nozzles 11 and 12 which are arranged in the coating station 10 and are used for applying the butyl adhesive onto the lower strip-like partial surface areas of the side surfaces of the strip 1. The throughput of the butyl adhesive through each of the nozzles 11 and 12 can be controlled and regulated by slides 11.1 and 12.1 driven by servomotors in such a way that the side surfaces of the strip 1 are coated with an adhesive layer 60 each with a substantially constant thickness, i.e. a thickness which is independent of the speed of the strip 1. For this purpose the drive motors of the slides 11.1 and 12.1 and optional downstream thickness measuring devices are linked to the machine control unit (not shown). The nozzles are displaceable according to the arrows for adjusting the distance of their orifices to the strips of different width.

In accordance with FIG. 4, at least the pairs of rollers downstream of the coating station 10 such as 6 and 7 in FIG. 1 are provided with a running surface profiled in a wedge-like manner for the lateral guidance of the strip 1, so that the illustrated rollers 6.1 and 6.2 only touch the strip at the edges of the side surfaces of the strip. The rollers, e.g. rollers 6.1 and 6.2, can be provided with a free-wheeling configuration or sit on the shafts of drive motors (not shown) which keep the circumferential speed of the roller synchronously and in agreement with the momentary or momentarily required strip running speed.

While the invention has been described in detail and with reference to specific embodiments thereof, it will be apparent to one skilled in the art that various changes and modifications can be made therein without departing from the spirit and scope thereof. Accordingly, it is intended that the present invention covers the modifications and variations of this invention provided they come within the scope of the appended claims and their equivalents.

What is claimed:

1. A method for producing an insulating glass pane structure formed from at least two glass panes, comprising:

withdrawing an elastoplastic strip from a delivery reel, the elastoplastic strip having a varying dimension along its width including a first, nominal width section and a second, reduced width section that is smaller in width than the nominal width section;

coating side surface area portions of the nominal width section of the strip with a first adhesive glue;

coating side surface area portions of the reduced width section of the strip with a second adhesive glue that is diffusion-proof against water vapor, wherein the second adhesive glue comprises a butyl adhesive;

pressing one side surface of the strip against a first glass pane to form a spacer, the strip being pressed close to an edge of the first glass pane;

applying and pressing the second glass pane to another side surface of the strip that opposes the side surface of the strip which is pressed against the first glass pane so as to form the glass pane structure;

measuring the coating thickness of the second adhesive during coating side surface area portions of the reduced width section of the strip to determine a deviation of the coating thickness from a predetermined setpoint value;

generating an error signal when there is a deviation of the coating thickness from a predetermined setpoint value; and modifiying the coating of the side surface area portions of the reduced width section of the strip with the second adhesive based upon the generated error signal so as to adjust the coating thickness of the second coating prior to any glass pane being applied to the strip, wherein the modification of the coating of the side surface area portions maintains an approximately constant coating thickness of the second adhesive;

wherein the strip is pressed against the first glass pane via an automatic operating station, the quantity of the second adhesive applied to the strip is regulated depending on a strip conveying speed that conveys the strip to be pressed to the first glass pane, and the coating thickness of the second adhesive is maintained approximately constant during changes of the strip conveying speed strip conveying speed;

providing a sagging section of the strip where the strip sags freely, and monitoring the sagging section of the strip with a sensor mechanism to maintain a degree of sagging of the sagging section of the strip between an upper/minimum vertical value and a lower/maximum vertical value.

2. A method for producing an insulating glass pane structure formed from at least two glass panes, comprising:

withdrawing an elastoplastic strip from a delivery reel, the elastoplastic strip having a varying dimension along its width including a first, nominal width section and a second, reduced width section that is smaller in width than the nominal width section;

coating side surface area portions of the nominal width section of the strip with a first adhesive glue;

coating side surface area portions of the reduced width section of the strip with a second adhesive glue that is diffusion-proof against water vapor;

pressing one side surface of the strip against a first glass pane to form a spacer, the strip being pressed close to an edge of the first glass pane;

applying and pressing the second glass pane to another side surface of the strip that opposes the side surface of the strip which is pressed against the first glass pane so as to form the glass pane structure;

measuring the coating thickness of the second adhesive during coating side surface area portions of the reduced width section of the strip to determine a deviation of the coating thickness from a predetermined setpoint value;

generating an error signal if there is a deviation of the coating thickness from a predetermined setpoint value; and modifying the coating of the side surface area portions of the reduced width section of the strip with the second adhesive based upon the generated error signal so as to adjust the coating thickness of the second coating prior to any glass pane being applied to the strip, wherein the modification of the coating of the side surface area portions maintains an approximately constant coating thickness of the second adhesive constant coating thickness of the second adhesive;

providing a sagging section of the strip where the strip sags freely, and monitoring the sagging section of the strip with a sensor mechanism to maintain a degree of sagging of the sagging section of the strip between an upper/minimum vertical value and a lower/maximum vertical value.

3. The method of claim 1, wherein the sensor mechanism comprises a plurality of sensors to monitor the degree of sagging of the sagging section of the strip between the upper/minimum and lower/maximum vertical values.

4. The method of claim 2, wherein the sensor mechanism comprises a plurality of sensors to monitor the degree of sagging of the sagging section of the strip between the upper/minimum and lower/maximum vertical values.

* * * * *